US005980365A

United States Patent [19]

Giebmanns

[11] Patent Number: 5,980,365

[45] Date of Patent: Nov. 9, 1999

[54] TOOL GRINDING MACHINE HAVING AT LEAST TWO SPINDLES

[75] Inventor: Karl-Heinz Giebmanns, Palm Coast, Fla.

[73] Assignee: International Tool Machines of Florida Inc., Palm Coast, Fla.

[21] Appl. No.: 08/979,987

[22] Filed: Nov. 26, 1997

[30] Foreign Application Priority Data

Nov. 26, 1996 [DE] Germany ..... 196-48-790

[51] Int. Cl.[6] ..... B24B 7/00

[52] U.S. Cl. ..... 451/72; 451/135; 451/211; 451/271; 451/362

[58] Field of Search ..... 451/56, 57, 58, 451/65, 72, 135, 137, 211, 212, 213, 215, 232, 271, 279, 375, 380, 387, 405, 362, 363

[56] References Cited

U.S. PATENT DOCUMENTS

| | | | |
|---|---|---|---|
| 415,886 | 11/1889 | Stuckel | 451/362 X |
| 1,905,651 | 4/1933 | Raule | 451/362 X |
| 1,986,797 | 1/1935 | DeLeeuw | 451/362 X |
| 4,587,763 | 5/1986 | Hahn | 451/72 X |
| 4,769,952 | 9/1988 | Pedrini | 451/363 X |
| 5,072,548 | 12/1991 | Girard et al. | 451/72 X |
| 5,480,343 | 1/1996 | Pedersen et al. | 451/57 X |

FOREIGN PATENT DOCUMENTS

| | | | |
|---|---|---|---|
| 950565 | 9/1949 | France | 451/362 |
| 3348060 | 9/1983 | Germany . | |
| 4113116 | 10/1991 | Germany . | |

*Primary Examiner*—Timothy V. Eley
*Attorney, Agent, or Firm*—Robert W. Becker & Associates

[57] ABSTRACT

A tool grinding machine has a moveable tool receiving member and a support rotatable about a vertical axis. The support includes a solid disk having a great mass allowing a vibration-free grinding at great output. Grinding spindles are arranged vertically on the disk for grinding a tool received in the tool receiving member. The grinding spindles have a vertical extension above the disk. The disk has a vertical thickness matching at least the vertical length of the grinding spindles.

18 Claims, 2 Drawing Sheets

DRAWING PROPOSAL

TOOL GRINDING MACHINE HAVING AT LEAST TWO SPINDLES

BACKGROUND OF THE INVENTION

The present invention relates to a tool grinding machine, especially for sharpening and regrinding drill bits, end-milling cutters, reamers, etc.

Tool grinding machines for sharpening or regrinding of cutting tools, especially end-milling cutters with spherical cutting heads are nowadays controlled by CNC control. In order to be able to adjust to different geometries of end-mill cutters with spherical cutter heads, the grinding machines need at least five CNC-controlled axes. This is also true for conventional and end-milling cutters and conical end-milling cutters with spherical cutter heads. The known tool grinding machines, in general, have a plurality of grinding wheels which can be moved into a respective grinding position in order to ensure the required flexibility during grinding of differently sized tools and tools of different geometries. In general, different suitable grinding wheels are provided for the different machining steps, such as, for example, spiral groove cutting, grinding of tool ends, regrinding and finish grinding, etc. This plurality of grinding wheels can be arranged adjacent to one another on a single grinding spindle, whereby the grinding wheels must be spaced from one another such that no hinderance during grinding of the tool with one or the other grinding wheels occurs. Instead of a plurality of grinding wheels on one single spindle, it is also possible to arrange a plurality of spindles having one or more grinding wheels thereat whereby the respectively required spindle is then moved into the working or grinding position. A drill bit grinding machine with two grinding wheels and two parallel grinding spindles is disclosed in German Patent 33 48 060 C2. A drill bit grinding machine, having a grinding wheel that is supported on a spindle connected to a horizontally linearly moveable slide on which the drive motor for the grinding spindle is also arranged, is known from German Patent 41 13 146 C2.

In the design having a plurality of grinding wheels on a single grinding spindle, grinding wheels having only a relatively small diameter between 50 and 100 mm can be used in order to avoid too great a distance between the grinding wheels and thus too great a projection of the grinding wheel past the grinding spindle. This is necessary because the danger of hindering one another is greater, the greater the diameter of the grinding wheel when a plurality of grinding wheels is arranged on a grinding spindle, especially when tools with spiral grooves such as end-milling cutters must be machined. Furthermore, for certain grinding machining steps, especially for grinding end-milling cutters with spherical cutter heads, grinding wheels with small diameters are required for grinding the groove within the spherical cutter head while for other machining steps at the same tool larger diameter grinding wheels are much more efficient. However, in order to avoid hinderance between the grinding wheels during grinding, the grinding wheels on a single spindle must be provided with substantially the same diameter.

In a known design with two grinding wheels on two grinding spindles, the grinding spindles are arranged coaxially to one another whereby this axis extends horizontally and the grinding wheels are moveable by rotation about a vertical axis, which extends approximately centrally between the two grinding spindles, can be moved into the machining position at the tool. The axis of rotation about which the grinding spindles with their respective grinding wheels are rotated in order to bring them into the respective working position is always spaced relatively far away from the grinding wheel so that even for a very stiff construction vibrations and indexing imprecisions will occur. The possibility of arranging the spindles at a very stiff support is also impeded by the fact that below the grinding spindle a free space must be available in order not to impede the movement of relatively long tools. For grinding at high output and great material removal rate, the stiffness of such a construction is often not sufficient.

When dressing the grinding wheels, it is necessary in these known tool grinding machines that the grinding wheels must be removed and transported to a separate dressing device in order for them to be machined.

It is therefore an object of the present invention to provide a tool grinding machine with at least two grinding spindles that allows to arrange the axis of the grinding spindles closely adjacent to one another and on a stiff support so that grinding can be performed at great output and at great material removal rate without causing vibrations and with great precision. Furthermore, it should be possible to dress the grinding wheels within the tool grinding machine.

SUMMARY OF THE INVENTION

A tool grinding machine according to the present invention is primarily characterized by:

A moveable tool receiving member;

A support rotatable about a vertical axis;

The support including a solid disk having a great mass allowing a vibration-free grinding at great output;

At least two grinding spindles arranged vertically on the disk for grinding a tool received in the tool receiving member;

The disk having a thickness matching almost the length of the grinding spindles.

Advantageously, the support further includes a solid shaft having an upper end to which the disk is connected.

Advantageously, the tool grinding machine further comprises a bearing member in which the support is rotatably and vertically movably supported, wherein the bearing member has an upper end face facing a bottom face of the disk. An indexing mechanism is provided that includes indexing projections and indexing depressions for receiving the indexing projections. The indexing projections are connected to either the upper end face or the bottom face and the indexing depressions are provided at the respective opposite face. Locking of the indexing mechanism is caused by gravity.

The upper end face of the bearing member has three such indexing projections uniformly distributed in a circumferential direction and the bottom face has preferably six of the indexing depressions positioned circumferentially at half the spacing between the indexing projections.

The indexing projections are preferably balls.

The tool grinding machine may further comprise a stationary piston, wherein the solid shaft has a bore at a lower end thereof and wherein the piston sealingly engages the bore. The piston comprises a pressure medium line communicating with the bore.

Preferably, the indexing mechanism includes an indexing drive acting on the solid shaft.

The tool grinding machine advantageously further comprises a dressing device, wherein the disk has an operating position in which a first one of the grinding spindles is positioned adjacent to the tool receiving member and a second one of the grinding spindles is positioned adjacent to the dressing device.

Expediently, the tool grinding machine further comprises a first drive for driving at least the first grinding spindle and a second drive for driving the second grinding spindle.

In a preferred embodiment, the tool grinding machine has at least six grinding spindles that are uniformly distributed in a circumferential direction of the disk. The grinding spindles comprise a pulley positioned below the bottom face of the disk. The first drive comprises a first motor having a drive pulley and a first drive belt guided about the drive pulley. The drive belt is at least guided about the pulley of the first grinding spindle without being guided about the pulley of the second grinding spindle. The second drive can be coupled to the second grinding spindle.

Advantageously, the second drive comprises a second motor vertically adjustably connected to the bearing member and a coupling device for coupling the second motor to the second spindle.

The dressing device preferably is moveable horizontally and vertically for bringing the dressing device into engagement at the second grinding spindle.

The dressing device may comprise a driven diamond grinding wheel.

The tool receiving member is preferably pivotable about a horizontal axis, moveable along the horizontal axis, and moveable radially relative to the horizontal axis.

Preferably, the tool receiving member is rotatable about a receiving axis thereof.

The tool grinding machine expediently further comprises a machine frame and a slide vertically slidably connected to the machine frame. A support housing is horizontally slidably connected to the slide. A hollow shaft is supported at the support housing and a support shaft is non-rotatably and axially slidably guided in the hollow shaft. The tool receiving member is supported by the support shaft.

Preferably, the tool grinding machine further comprises a holder attached to the support shaft, wherein the tool receiving member is slidably fastened to the holder to be radially moveable relative to the support shaft.

The tool grinding machine may further comprise a drive unit including a belt drive for driving in rotation the tool receiving member. The belt drive may comprise a stationary pulley having a slidable drive shaft acting on the tool receiving member. The drive unit further comprises a rotation controller for an angle-exact rotation of the tool receiving member.

According to the present invention, it is suggested that the tool receiving member is moveable about all required axes and that the tool grinding machine comprises a solid support of great mass which is rotatable about a vertical axis and supports at least two driven, vertically arranged grinding spindles with grinding wheels. By arranging the grinding spindles parallel to the vertical axis of the rotatable support, they can be moved closely to the axis of rotation of the support, but provide in their respective working position sufficient free space parallel to the grinding spindle in order to allow machining of elongate tools.

The projection of the grinding spindle is negligible and the solid support of great mass ensures a vibration-free machining at great output.

While one of the grinding spindles with its grinding wheel is in a working position, the grinding wheel of another grinding spindle in the area of the dressing device can be dressed or trued without having to remove the grinding spindle and its grinding wheel from the tool grinding machine.

The support can preferably be comprised of a solid disk having a thickness corresponding to approximately the length of the grinding spindle, and a solid shaft, whereby the shaft is rotatably supported in a bearing member of the machine frame and is also vertically moveable. Between the upper end face of the bearing member and the bottom face of the disk indexing projections and indexing depressions of an indexing mechanism are arranged, and the locking of the indexing mechanism occurs by gravity.

When at the upper end face of the bearing member three uniformly distributed indexing projections in the form of balls are provided and at the bottom face of the disk six indexing inserts with depressions are positioned at half the spacing between the indexing balls, a three-point support of the disk is realized in the locked position of the indexing mechanism. With the six indexing inserts six grinding spindles can be sequentially positioned with their grinding wheels in the working position at the tool.

Since the lifting and lowering of the support as well as a rotation is required only for the purpose of indexing of the respectively needed grinding spindle with grinding wheel, it is possible to provide a solid shaft for the disk with a bore. A piston that is stationary (i.e., fastened to the machine frame, can be positioned in a sealing manner in the bore. The piston is provided with a pressure medium line. The solid shaft may also be provided with an indexing drive so that switching can be performed by briefly lifting the support by supplying a pressure medium (hydraulic medium) via the pressure medium line and rotation can then be performed by the indexing drive. This indexing drive must not precisely position the disk in the respective working position because the actual indexing action in the prescribed position occurs by gravitational locking via the indexing projections and indexing depressions.

Preferably, independent drive units can be provided at least for the grinding spindle in the working position and for the grinding spindle in the dressing position so that both method steps can be performed independently but also simultaneously, if desired.

In an especially preferred embodiment of the tool grinding machine, six or more grinding spindles are uniformly distributed about the disk whereby each grinding spindle is provided below the bottom face of the disk with a projecting pulley. A belt drive is guided at least about the pulley of the grinding spindle in the working position and about the pulley of a drive motor. The pulley of the grinding spindle in the dressing position is not driven by this belt drive, and the drive for the grinding spindle in the dressing position can be coupled in this position with the respective grinding spindle.

Preferably, the drive for the grinding spindle in the dressing position may be comprised of a drive motor that is vertically adjustably connected to the bearing member and comprises a coupling that can be engaged axially by the grinding spindle in the dressing position. In this manner, the drive for the grinding spindle in the dressing position must only be coupled to the grinding spindle for performing a dressing step.

The dressing tool of the dressing device can preferably be a diamond grinding wheel that can be moved in the vertical as well as in the horizontal direction into engagement with the grinding wheel at the grinding spindle.

When the tool receiving member, according to a preferred embodiment of the invention, is pivotable about a horizontal axis, displaceable in the direction of this axis, radially displaceable relative to this axis as well as rotatable, and when for this purpose the tool receiving member is supported by a shaft, which is non-rotatably but axially displaceably supported in a precisely supported hollow shaft, whereby the hollow shaft is arranged on a support housing that is guided horizontally on a slide and the slide is vertically guided at the machine frame, the tool receiving member can be moved in all required axes. These movements are advantageously CNC-controlled.

The tool receiving member can be radially displaceably connected to a support that is fastened to the non-rotable shaft, while the rotary drive has a belt drive with stationary pulley and a drive shaft that is movably guided in one pulley. The rotary drive acts via the drive shaft onto the tool receiving member.

A rotation controller on the stationary pulley provides an angle-precise rotation of the tool receiving member so that no imprecisions in the rotational movement of the tool to be ground will occur even when the belt drive does not work without slip.

Inventively, a plurality of grinding spindles, for example, six grinding spindles are supported in the support so as to have a vertical axis of rotation. The support is solid and has a great mass so that a vibration-free running of the grinding wheels can be ensured. The support rests in the working position on three points and the weight of the support as well as of the spindles ensures gravitational locking of the indexing mechanism in the selected indexing position. Each grinding spindle is provided at its end opposite the grinding wheel with a pulley that serves at the same time as a coupling element. A drive belt engages five of the six pulleys of the grinding spindles which are thus simultaneously driven by an electric motor. With this arrangement one of the grinding spindles, respectively, its pulley is not in contact with the drive belt and this grinding spindle is positioned diametrically opposite the grinding spindle in the working position. In this position, the disengaged grinding spindle can be driven by an independent drive motor by coupling a coupling element at the shaft of the drive motor with the coupling element at the pulley of the grinding spindle so that this grinding spindle is rotated with its grinding wheel at a suitable velocity for dressing or truing the grinding wheel, independent of the grinding cycle. For the dressing process a dressing device is used that can be controlled about two axes by a CNC control. With this arrangement, each grinding wheel can be dressed without the dressing process having any effects on the grinding process. It is possible to provide at least six grinding wheels with different shapes and dimensions for the grinding process without the grinding wheels hindering one another.

If the tool to be ground is designed such that the grinding wheels will not hinder one another, it is possible to arrange more than one grinding wheel on one grinding spindle and can be used for sharpening or regrinding drill bits, end-milling cutters, reamers, etc. Since the grinding spindles are arranged at the periphery of the support, respectively, its disk, there is enough free space available parallel to the grinding spindle axis in order to be able to grind elongate or very long tools. The three points of the three-point supporting action of the support can be arranged at a large spacing relative to one another on the disk of the support so that the stiffness of the gravitational locking action is improved and the precision of indexing is also increased.

BRIEF DESCRIPTION OF THE DRAWINGS

The object and advantages of the present invention will now appear more clearly from the following specification in conjunction with the accompanying drawings, in which.

DESCRIPTION OF PREFERRED EMBODIMENTS

Figure 1:
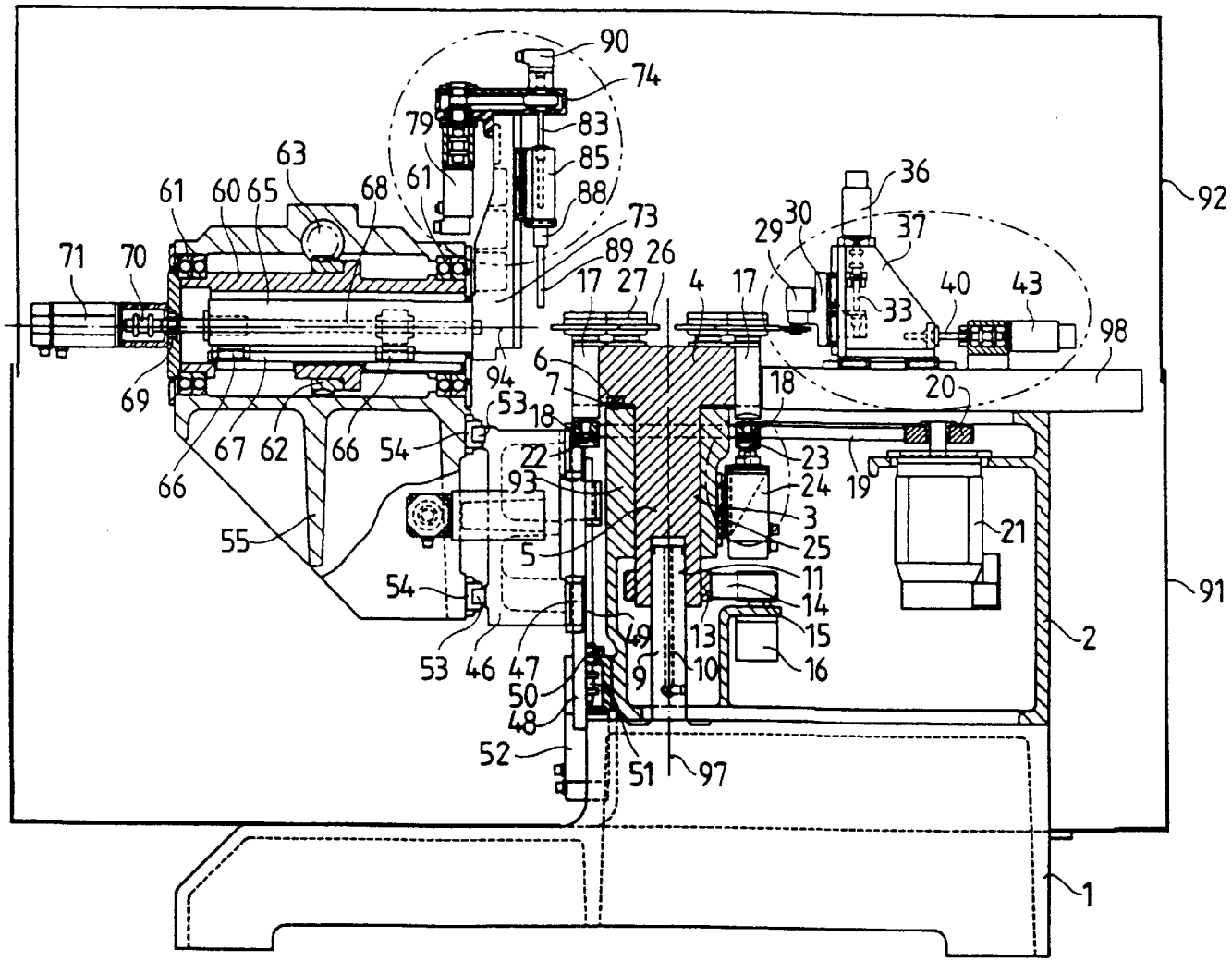
FIG. 1 shows a schematic side view, partly in section, of the inventive tool grinding machine.
Figure 4:
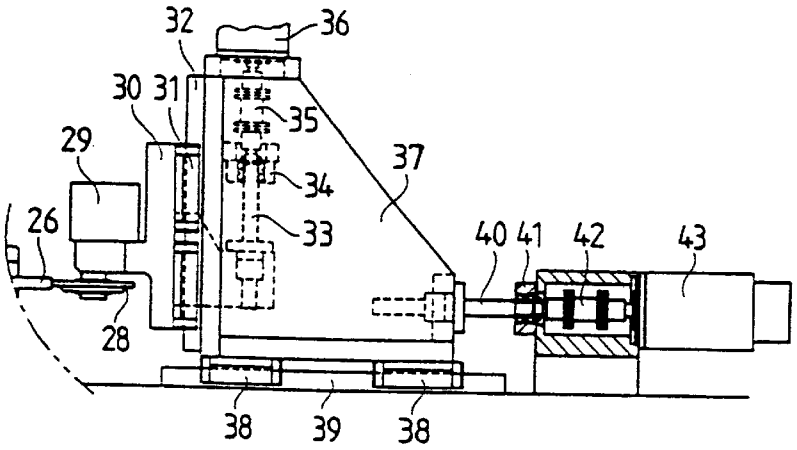
FIG. 4 shows a schematic side view of the dressing device.
Figure 3:
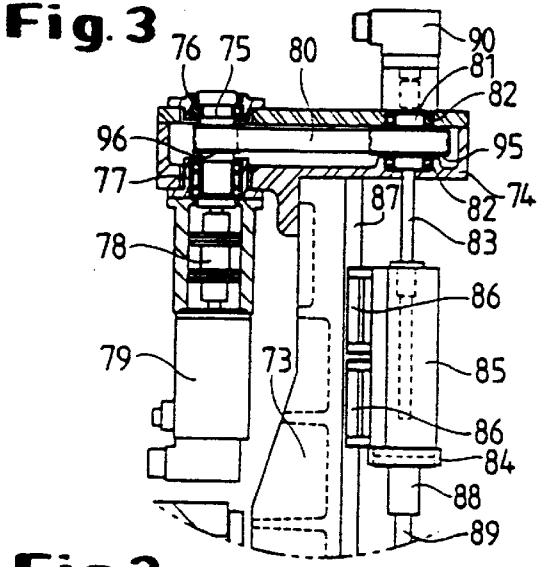
FIG. 3 shows an enlarged detailed view, partly in section, of the tool receiving member and its drive unit.

The present invention will now be described in detail with the aid of several specific embodiments utilizing FIGS. 1 through 4.

A sheet metal container 91 is connected to a support frame 1 and is provided for catching the cooling liquid used for the grinding process and also for trapping the cuttings removed by the grinding process. A machine frame 2 is connected to the support frame 1 and has at its lateral area a bore 3 for a solid shaft 5. This solid shaft 5 and the disk 4 form a unitary part and serve as a support for six grinding spindles 17 which are arranged in the area of the periphery of disk 4.

At the bottom face of the disk 4, six indexing inserts 6 with depressions for receiving three indexing balls 7 arranged at the upper end face of the bearing member 93 are provided. This disk 4 rests by gravitational action via the indexing mechanism (inserts 6 and the three indexing balls 7) with a three-point supporting action on the shaft 5 and is thus lockable in a respective selected position.

In the area of the lower end of the shaft 5, a bore 11 is arranged which together with the stationary piston 9, which is guided in a sealing manner within bore 3, provides a hydraulic piston-cylinder unit. The piston 9 is provided with a hydraulic line 10 (pressure medium line) via which a hydraulic medium (pressure medium) can be introduced into the cylinder space of the bore 11 above the piston 9 for lifting the disk 4 and the shaft 5. When the disk 4 is lifted together with the shaft 5 in this manner so that the depressions of the inserts 6 are spaced from the indexing projections or balls 7, the disk 4 and the shaft 5 can be freely rotated about the vertical axis 97.

Figure 2:
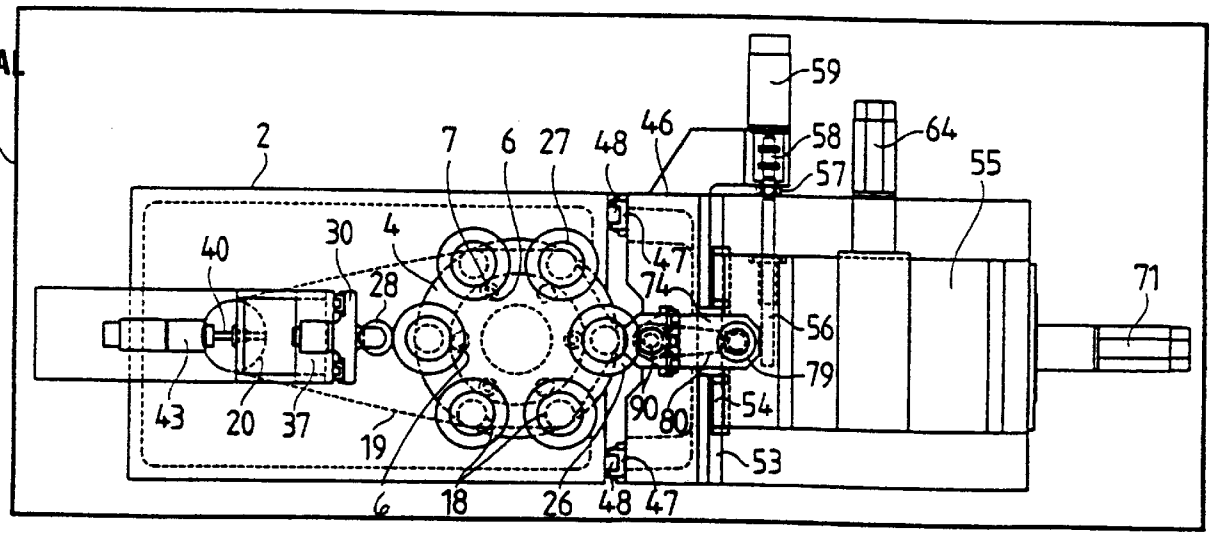
FIG. 2 shows a plan view of the tool grinding machine of FIG. 1.

For this purpose, at one end of the shaft 5 a pulley 13 is provided which is connected by a drive belt 14 to a pulley 15 at the drive motor 16. The drive motor 16 rotates the disk 4 and the shaft 5 about a certain angular distance in order to bring a grinding wheel 26, fastened by a spindle flange 27 to a grinding spindle 17, into a grinding position in which the grinding wheel 26 is opposite the tool 89 to be ground. The exact indexing of the respective required grinding wheel is realized by the aforementioned indexing inserts 6 and the indexing projections or balls 7 by gravity when the disk 4 with the shaft 5 is lowered by relieving pressure via the hydraulic line 10. The six grinding spindles 17, shown in FIG. 2, are uniformly spaced relative to one another and extend with their axes parallel to the axis of rotation 97 in the area of the periphery of the disk 4. The grinding wheels are positioned above the disk 4 while the pulleys 18 arranged at the grinding spindles 17 are below the bottom face of the disk 4.

The (vertical) thickness of the disk 4 is such that the grinding spindles are substantially supported with their entire length within the disk. This ensures a safe and substantially vibration-free support of grinding spindle 17 while at the same time a large mass is provided for the disk 4 and the shaft 5. This large mass also contributes to the substantially vibration-free running of the grinding wheels 26 due to its great stiffness and inertia.

A drive motor 21 is arranged parallel to the axis of the disk 4 and shaft 5 in the machine frame 2. It has a pulley 20 that drives five of the six grinding spindles 17 with its drive belt 19 because the engagement angle of the drive belt 19 is selected such that the pulley 20 will not drive the sixth grinding spindle 17. This grinding spindle 17 can be rotated by a drive motor 24 independent of the other five grinding spindles 17. For this purpose, the grinding motor 24 comprises a conical coupling element 23 that can be coupled to a conical opening 22 in the drive pulley 18 for connecting motor 24 and the sixth, independently driven spindle 17. For this purpose, the drive motor 24 is supported by slide members 25 at the bearing member 23 and can be moved into the coupled or decoupled position as desired.

While the five grinding spindles 17 with their grinding wheels 26 are rotated by the drive belt 19 of the drive motor 21 and one of the grinding wheels 26 is in a working position, the grinding wheel 26 diametrically opposite is being dressed. For this purpose, a dressing device in the form of diamond wheel 28 is arranged on a plate 98 of the machine frame 2. This diamond wheel 28 is rotated by a drive motor 29 supported at a slide 30 and slidable by guide shoes 31 on vertical guide rails 32 on a stand 37. The slide 30 can be moved by a servomotor 36 vertically along the guides 32 since the servomotor 36 is connected by a coupling 35 to the recirculating ball screw 33 which engages one projection of the slide 30 and with its other end is supported in a bearing 34 at the stand 37. The stand 37 is supported by guide shoes 38 on horizontal guide rails 39 and can be moved in the horizontal direction by a servomotor 43 which is coupled by a coupling 42 to a recirculating ball screw 40 that engages the stand 37. A bearing 41 supports the recirculating ball screw 40 in the area of the coupling 42.

For dressing the grinding wheel 26 in the dressing position, the drive motor 24 is moved by a non-represented drive vertically in the upward direction until the conical coupling element 23 engages the conical opening 20 of the pulley 18. Now the grinding wheel 26 is driven by the motor 24 independent of the other grinding wheels 26, while the diamond wheel 28 is moved by the servomotors 36 and 43 into the dressing position. The diamond wheel 28 can be a shaped disk in order to provide the grinding wheel 26 with a predetermined shape or it can be used to dress the grinding wheel 26 to a true cylindrical shape.

Vertical guide rails 48 are arranged on a vertical side of the machine frame 2 adjacent to the bearing member 93 and a slide 46 having guide shoes 47 is vertically guided therein. The vertical movement of the slide 46 is realized by a recirculating ball screw 49 which is supported at the machine frame 2 in a bearing 50 and is coupled by a coupling 51 to the servomotor 52. Parallel horizontal guide rails 53 are arranged at the slide 46 on which a housing 55 having guide shoes 54 can be moved in the horizontal direction. This movement is also realized by a recirculating ball screw 56 which is supported at the housing 55 in a bearing 57 and coupled with a coupling 58 to a servomotor 59.

The support housing 55 supports a hollow shaft 60 that is supported by precision roller bearing 61. A worm gear 62 is arranged at the hollow shaft 60 and is engaged by a worm screw 63 driven by a servomotor 64. This servomotor 64 allows the rotation of the hollow shaft 60 about its horizontal axis 94.

Guide rails 67 are arranged within the hollow shaft 60 which engage the guide shoes 66 of a square shaft 65. A recirculating ball screw 68 is connected coaxially to the shaft 65 and is supported in a bearing 69 at the hollow shaft 60. The recirculating ball screw 68 is coupled by a coupling 70 to the servomotor 71 and can be moved by a servomotor 71 coaxially to the hollow shaft 60, but cannot be rotated relative to the hollow shaft 60. A support 73 is connected to the shaft 65 and guides a housing 85 for the tool receiving member 88. The housing 85 has guide shoes 86 engaging guide rails 87 at the support 73 and can thus be radially moved relative to the horizontal axis 94. The tool 89 to be ground is connected to the tool receiving member 88. The radial movement of the housing 85 is effected by a grooved drive shaft 83 which is axially moveable within the pulley 95 but is rotationally fixedly connected to this pulley 95. The axially stationary pulley 95 is supported by roller bearing 82 in a housing 74 that is connected to the support 73.

A pulley 96 is supported by roller bearing 77 with a parallel axis orientation to the drive shaft 83 and to the pulley 95. This pulley 96 is coupled by coupling 78 to the rotary drive 79 and transmits its rotation onto the pulley 95 and thus onto the drive shaft 83 via the drive belt 80. Since the drive action by a drive belt 80 has slip, a rotation controller 90 is arranged on the shaft 81 for the pulley 95 which determines the exact angular position of the pulley 95 and thus of the drive shaft 83 . It controls the rotation of the servomotor 79 accordingly in order to ensure the angularly exact rotation of the tool 89 to be ground, when, for example, spiral grooves are to be ground into the tool 89.

The entire tool grinding machine is closed off by an upper cover 92 so that the cooling liquid used during grinding and the removed cuttings cannot contaminate the surroundings but is instead collected in the container 91 and can be guided from there into a filtering device.

With the inventive embodiment, the tool 89 to be ground can be moved about six axes, i.e., vertically by movement of the slide 46, horizontally by the movement of the support housing 55, in the axial direction of the hollow shaft 60 by movement of the shaft 65, rotatably about the horizontal axis 94, radially along the guides 87 at the support 73, and rotatably about its own axis.

In this manner, all machining steps at the tool 89 to be ground can be performed in a CNC-controlled fashion in connection with the correspondingly shaped grinding wheels 26 at the grinding spindles 17 according to the respective working position, while at the same time an unused grinding wheel 26 can be dressed by the diamond wheel 28.

The solid construction of the support frame 1 and of the machine frame 2 and the great mass of the disk 4 and the shaft 5, which receive the grinding spindles 17, provide for a substantially vibration-free running of the grinding wheel 26 in the respective working position. This is further enhanced by the spacing of the grinding spindles 17 from the axis of rotation 97 being minimal and the indexing inserts 6 and the indexing balls 7 being directly adjacent to the grinding spindles 17. Based on this, locking of the indexing mechanism via indexing inserts 6 and the indexing balls 7 by gravity is sufficient in order to ensure a safe and exact indexing of the grinding wheels 26 in the respective working position.

Due to the belt drive for the grinding spindles and for indexing of the disk 4 with the grinding spindles 17, there is no need for special compensation measures when the disk must be lifted by a few millimeters in order to further rotate it because the belt drive can compensate this minimal axial movement without problems.

With the inventive tool grinding machine it is also possible to arrange a plurality of dressing tools radially to the disk 4 in order to reshape in this manner shaped grinding wheels 26 by differently shaped profiled diamond wheels 28 without having to stop operation of and open the tool grinding machine in order to exchange the diamond wheels.

The specification incorporates by reference the disclosure of German 196 48 790.0 of Nov. 26, 1996.

The present invention is, of course, in no way restricted to the specific disclosure of the specification and drawings, but also encompasses any modifications within the scope of the appended claims.

What is claimed is:

1. A tool grinding machine comprising:

a tool receiving member;

a support rotatable about a vertical axis;

said support including a solid disk having a great mass allowing a vibration-free grinding;

at least two grinding spindles arranged vertically on said disk so as to extend parallel to said vertical axis of said support for grinding a tool received in said tool receiving member, wherein said tool receiving member is movable relative to said disk and said grinding spindles;

said disk having a thickness and said grinding spindles having a length, wherein said thickness of said disk is such that said spindles are supported along most of said length in said disk.

2. A tool grinding machine according to claim 1, wherein said support further includes a solid shaft having an upper end to which said disk is connected.

3. A tool grinding machine according to claim 2, further comprising:

a bearing member in which said support is rotatably and vertically movably supported, wherein said bearing member has an upper end face facing a bottom face of said disk;

an indexing mechanism including indexing projections and indexing depressions for receiving said indexing projections;

said indexing projections connected to one of said upper end face and said bottom face and said indexing depressions provided in the other of said upper end face and said bottom face, wherein locking of said indexing mechanism is caused by gravity.

4. A tool grinding machine according to claim 3, wherein said upper end face of said bearing member has three of said indexing projections uniformly distributed in a circumferential direction thereof and wherein said bottom face has six of said indexing depressions positioned circumferentially at half a spacing between said indexing projections.

5. A tool grinding machine according to claim 4, wherein said indexing projections are balls.

6. A tool grinding machine according to claim 3, further comprising a stationary piston, wherein said solid shaft has a bore at a lower end thereof, wherein said piston sealingly engages said bore, and wherein said piston comprises a pressure medium line communicating with said bore.

7. A tool grinding machine according to claim 3, wherein said indexing mechanism includes an indexing drive acting on said solid shaft.

8. A tool grinding machine according to claim 3, further comprising a dressing device, wherein said disk has an operating position in which a first one of said grinding spindles is adjacent to said tool receiving member and a second one of said grinding spindles is adjacent to said dressing device.

9. A tool grinding machine according to claim 8, further comprising a first drive for driving at least said first grinding spindle and a second drive for driving said second grinding spindle.

10. A tool grinding machine according to claim 9, wherein at least six of said grinding spindles are uniformly distributed in a circumferential direction of said disk, wherein each one of said grinding spindles comprises a pulley positioned below said bottom face of said disk, wherein said first drive comprises a first motor having a drive pulley and a drive belt guided about said drive pulley, wherein said drive belt is at least guided about said pulley of said first grinding spindle without being guided about said pulley of said second grinding spindle, and wherein said second drive is detachably coupled to said second grinding spindle.

11. A tool grinding machine according to claim 10, wherein said second drive comprises a second motor vertically adjustably connected to said bearing member and a coupling device for coupling said second motor to said second spindle.

12. A tool grinding machine according to claim 8, wherein said dressing device is movable horizontally and vertically for bringing said dressing device into engagement at said second grinding spindle.

13. A tool grinding machine according to claim 8, wherein said dressing device comprises a driven diamond grinding wheel.

14. A tool grinding machine according to claim 1, wherein said tool receiving member is pivotable about a horizontal axis, movable along said horizontal axis, and movable radially relative to said horizontal axis.

15. A tool grinding machine according to claim 14, wherein said tool receiving member is rotatable about a receiving axis thereof.

16. A tool grinding machine according to claim 14, further comprising:

a machine frame and a slide vertically slidably connected to said machine frame;

a support housing horizontally slidably connected to said slide;

a hollow shaft supported at said support housing;

a support shaft non-rotatably and axially slidably guided in said hollow shaft;

said tool receiving member supported by said support shaft.

17. A tool grinding machine according to claim 16, further comprising a holder attached to said support shaft, wherein said tool receiving member is slidably fastened to said holder to be radially movable relative to said support shaft.

18. A tool grinding machine according to claim 16, further comprising a drive unit including a belt drive for driving in rotation said tool receiving member, said belt drive comprising an axially stationary pulley having a slidable drive shaft acting on said tool receiving member, said drive unit further comprising a rotation controller for an angle-exact rotation of said tool receiving member.

* * * * *